US006311357B1

(12) United States Patent
Horian

(10) Patent No.: US 6,311,357 B1
(45) Date of Patent: Nov. 6, 2001

(54) SHOE SHINE KIT

(76) Inventor: Richard C. Horian, 11952 Montana Ave. #102, Los Angeles, CA (US) 90049-5030

( * ) Notice: Subject to any disclaimer, the term of this patent is extended or adjusted under 35 U.S.C. 154(b) by 0 days.

(21) Appl. No.: 09/621,841

(22) Filed: Jul. 24, 2000

(51) Int. Cl.[7] ..... A47L 13/12

(52) U.S. Cl. ..... 15/106; 15/114; 401/129; 206/229; 206/361

(58) Field of Search ..... 206/223, 229, 206/361; 15/1.52, 106, 114, DIG. 14; 401/125, 129; 132/313

(56) References Cited

U.S. PATENT DOCUMENTS 2,743,474 * 5/1956 Johnson ..... 15/114
4,232,871 * 11/1980 Horian et al. ..... 15/114
4,615,439 10/1986 Weissenfels .

OTHER PUBLICATIONS

First Page of U.S. Patent No. 4,821,932, Petryshyn, Apr. 18, 1989.

First Page of U.S. Patent No. 4,049,306, Caputi, Sep. 20, 1977.

First Page of U.S. Patent No. 4,706,807, Andres, Nov. 17, 1987.

First Page of U.S. Patent No. 5,007,754, Zierhut, Apr. 16, 1991.

First Page of U.S. Patent No. 5,188,472, Sgro, Feb. 23, 1993.

Abstract of U.S. Patent No. 5,446,936, Park, Sep. 5, 1995.

Abstract of U.S. Patent No. 4,735,319, Mead, Apr. 5, 1988.

Claims of U.S. Patent No. D291,022, Erickson, Dec. 10, 1984.

Abstract of U.S. Patent No. 4,538,727, Solloway, Sep. 3, 1985.

* cited by examiner

*Primary Examiner*—David T. Fidei
(74) *Attorney, Agent, or Firm*—Lyon & Lyon LLP

(57) ABSTRACT

A shoe shine kit including a case with a cavity therein. A buffer pad is affixed to the case with a layer of napped material attached thereto. The case contains three containers with lids all integrally formed with the case. Polish is contained within the containers. Applicators are retained through interference fit in seats defined within the cavity of the case. The applicators each include a handle and an applicator pad having material to which shoe polish adheres.

10 Claims, 1 Drawing Sheet

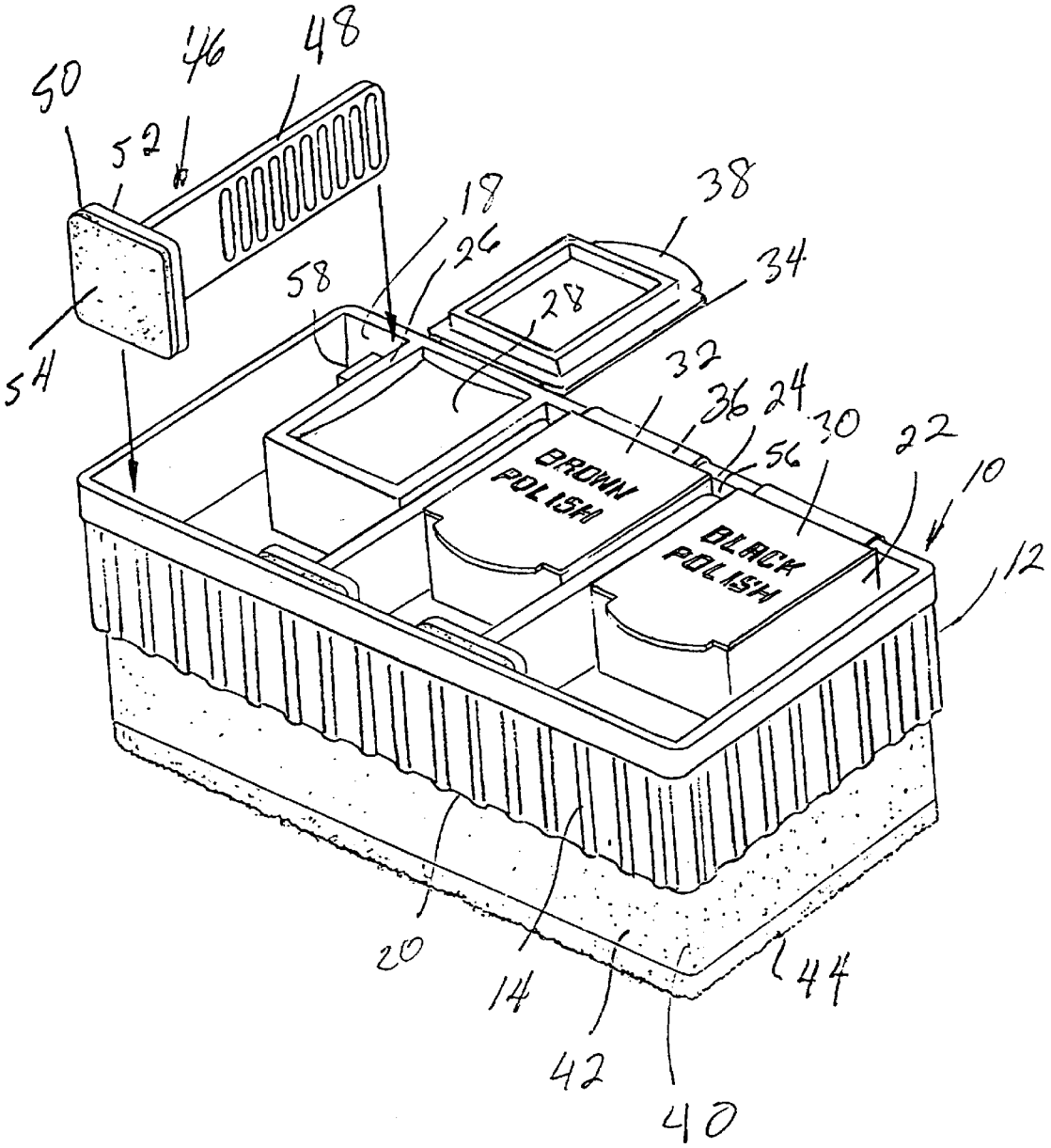
50
46
48
52
54
58
18
26
38
34
28
32
36
24
30
56
22
10
12
BROWN POLISH
BLACK POLISH
20
14
42
40
44

SHOE SHINE KIT

FIELD OF THE PRESENT INVENTION

The field of the present invention is kits for shining shoes.

BACKGROUND OF THE INVENTION

Shoe shine kits have long been available for the maintenance of shoe surfaces. Shoe polish typically comes in a wax or liquid form. Shoe polish primarily is comprised of a wax with a petroleum distillate base with appropriate color dye added and other ingredients. Albeit many colors are available, a selection of black, brown and neutral provide the most used options. Neutral wax polish provides the polishing function without contributing a dye so that shoes which do not fall within the most common color categories can be polished.

Wax polish typically is presented in round metal cans or jars. The polish is typically accessed through the use of a rag or applicator pad or brush. A buffing system is then employed which may include brushes, pads or large pieces of cloth. With these components, wax is applied and then buffed to a shine.

The components used in the shoe polishing process are known to have been included in containers, old shoe boxes, paper bags and the like. Such common methods typically do not lend themselves to convenience, compactness and inexpensive manufacture.

SUMMARY OF THE INVENTION

The present invention is directed to shoe shine kits including a case, a plurality of containers, a buffer pad and a plurality of applicators.

In a first separate aspect of the present invention, the case includes a cavity in which the containers, seats for the applicators and the applicators themselves may be positioned. A buffer pad is affixed to the other side. This arrangement allows for the case to be employed as a handle and yet contain and support the other components necessary in the shoe shine process.

In a second separate aspect of the present invention, lids are employed with the containers. These lids may be connected by hinges to close the containers. These elements may also be integrally formed with the case.

In a third separate aspect of the present invention, the applicators include handles and applicator pads. The handles are positionable within slots forming the seats with the handles being in interference fit with the slots. A separate applicator may then be available for each color contained within the containers.

In a fourth separate aspect of the present invention, the buffer pad includes a foam pad with a layer of napped material affixed thereto. The pad is affixed to the case such that the case can act as a handle for buffing the wax.

In a fifth separate aspect of the present application, any of the foregoing aspects are contemplated to be employed in combination to better advantage.

Accordingly, it is an object of the present invention to provide an improved shoe shine kit. Other and further objects and advantages will appear hereinafter.

BRIEF DESCRIPTION OF THE DRAWING

The FIGURE is a perspective view of a shoe kit with one applicator and one lid moved from the stowed position.

DETAILED DESCRIPTION OF THE PREFERRED EMBODIMENT

Turning in detail to the drawing, a case 10 is shown to have peripheral sides 12 which are ribbed for increased manual purchase. The ribs 14 may also act to selectively strengthen the case if made of thin walled material. A rectangular border 16 is also shown about the peripheral sides 12 adjacent to one of the two opposed major sides of the case 10. One side of the case 10 opens into a cavity 18. The opposed side has a flange extending outwardly from the case 10 about the periphery. In reality, the flange 20 is an extension of the peripheral sides 12. Conveniently, the case in plan is 4⅛"×2⅜". The overall height of the kit including the case 10 and a buffer pad described below may appropriately be 1¾" thick.

Internally of the cavity 18, three containers 22, 24 and 26 are arranged along one side. These containers 22, 24, 26 preferably contain black polish, brown polish and neutral polish 28. The bottoms of the containers 22, 24, 26 may be elevated so as to limit the amount of polish 28 supplied. Integrally formed with the case 10, the containers 22, 24, 26 are rigidly associated therewith. Lids 30, 32 and 34 are hinged to the wall of the case 10. Advantageously, the case, containers and lids are integrally molded and the hinges 36 may be thin section flexible strips. Because of these hinges 36, it is advantageous to make the molding of polypropylene plastic. The lids 30, 32 and 34 may contain printed indicia to identify the color of polish enclosed. These lids may also close in interference fit with the containers 22, 24, 26 to retain the lids in place. A thumb tab 38 facilitates opening of any of the containers 22, 24, 26.

A buffer pad 40 is arranged on the other side of the case 10 from the cavity 18. The buffer pad 40 includes a foam pad affixed to the case 10. The foam pad 42, operating as a block, provides substantial rigidity to lateral deflection but allows compression for conformance to a curved surface. A layer 44 of napped material is affixed to the foamed pad 42 to form a buffing surface. The layer 44 is itself flexible to provide some ability to conform to the contour of a shoe with curved surfaces.

Applicators 46 are removably positionable within the cavity 18. The three applicators 46 include a handle 48 of reasonably rigid material. This handle may be approximately two inches long so as to provide adequate purchase and yet allow placement laterally within the cavity 18 of the case 10 as shown in the figure. The applicators 46 further include applicator pads 50 composed of plates 52 and material 54 to which shoe polish adheres. This material 54 may be 1/16" felt to retain and transfer an ample amount of polish during application. The plates 52 and material 54 are preferably of a dimension that they can move laterally within the containers 22, 24, 26 to insure that shoe polish will adhere to the material 54.

Seats 56 are arranged among the containers 22, 24, 26 as can be seen in the FIGURE. An upstanding tab 58 receives one of the applicators 46 as there are the same number of applicators 46 as there are containers 22, 24, 26. The seats 56 define slots which receive the handles 48. The handles 48 are sized to be in interference fit with the slots of the seats 56 to insure retention.

In operation, one of the lids 30, 32, 34 is opened to expose the polish 28. An adjacent applicator 46 is then removed from the cavity 18 and the applicator pad 50 is lightly scrubbed in the polish 28. The polish 28 collected on the applicator 46 is then applied to a shoe. Upon complete application of the polish 28, the lid 30, 32, 34 is closed and the applicator 46 is either returned to its associated seat 56 or set aside. After an appropriate interval, the case 10 may be held and the buffer pad 40 rubbed on the applied polish 28 until the shoe shines. With all components returned to the assembly, the kit is ready for storage.

Accordingly, an improved shoe shine kit is enclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A shoe shine kit comprising a case including two opposed sides with a cavity in one of the opposed sides;

a plurality of containers in the cavity;

a plurality of seats among the plurality of containers;

a buffer pad affixed to the other of the opposed sides;

a plurality of applicators each including a handle and an applicator pad on one end of the handle, the plurality of applicators being positionable in the plurality of seats, respectively.

2. The shoe shine kit of claim 1, the plurality of containers each being rigidly associated with the case and including a lid to close each container.

3. The shoe shine kit of claim 2, there being a plurality of lids associated with the plurality of containers, respectively, each lid having a hinge between the case and the lid.

4. The shoe shine kit of claim 3, the case, the plurality of containers, the plurality of lids and the hinges being integrally formed.

5. The shoe shine kit of claim 1, the plurality of seats including slots between the plurality of containers, the slots and the handles having an interference fit therebetween.

6. The shoe shine kit of claim 1, the case further including a flange about the periphery of the other of the opposed sides and extending outwardly from the other of the opposed sides, the buffer pad extending from within the flange and including a foam pad and a layer of napped material affixed to the foam pad.

7. The shoe shine kit of claim 1, the case and the plurality of containers being integrally formed.

8. The shoe shine kit of claim 1, the applicator pads having plates, respectively, on the ends of the handles and material to which shoe polish adheres affixed to one side of the plates.

9. A shoe shine kit comprising a case including two opposed sides with a cavity in one of the opposed sides;

a plurality of containers in the cavity, the plurality of containers each being rigidly associated with the case and including a plurality of lids to close the plurality of containers, respectively, each lid having a hinge between the case and the lid;

a plurality of seats among the plurality of containers, the plurality of seats including slots between the plurality of containers;

a buffer pad affixed to the other of the opposed sides;

a plurality of applicators each including a handle and an applicator pad on one end of the handle, the plurality of applicators being positionable in the plurality of seats, respectively, the slots and the handles having an interference fit therebetween, the case, the plurality of containers, the plurality of lids and the hinges being integrally formed, the applicator pads having plates, respectively, on the ends of the handles and material to which shoe polish adheres affixed to one side of the plates.

10. The shoe shine kit of claim 9, the case further including a flange about the periphery of the other of the opposed sides and extending outwardly from the other of the opposed sides, the buffer pad extending from within the flange and including a foam pad and a layer of napped material affixed to the foam pad.

* * * * *